US009424974B2

(12) United States Patent
Roy et al.

(10) Patent No.: US 9,424,974 B2
(45) Date of Patent: Aug. 23, 2016

(54) DRY-TYPE TRANSFORMER AND METHOD OF MANUFACTURING A DRY-TYPE TRANSFORMER

(71) Applicant: ABB Technology AG, Zurich (CH)

(72) Inventors: Carlos Roy, Zaragosa (ES); Rafael Murillo, Zaragosa (ES); Lorena Cebrian Lles, Zaragosa (ES)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/961,577

(22) Filed: Aug. 7, 2013

(65) Prior Publication Data

US 2013/0321113 A1 Dec. 5, 2013

Related U.S. Application Data

(63) Continuation of application No. PCT/EP2012/051417, filed on Jan. 30, 2012.

(30) Foreign Application Priority Data

Feb. 8, 2011 (EP) ..... 11153738

(51) Int. Cl.
*H01F 27/08* (2006.01)
*H01F 27/32* (2006.01)
(Continued)

(52) U.S. Cl.
CPC ..... *H01F 27/008* (2013.01); *H01F 27/288* (2013.01); *H01F 27/322* (2013.01); *H01F 41/06* (2013.01); *H01F 41/063* (2016.01); *Y10T 29/49071* (2015.01)

(58) Field of Classification Search
CPC ... H01F 27/362; H01F 27/365; H01F 27/322; H01F 27/22; H01F 27/2876
USPC ..... 336/84 R, 84 C, 84 M, 60, 61, 62
See application file for complete search history.

(56) References Cited

U.S. PATENT DOCUMENTS 2,553,324 A * 5/1951 Lord ..... H01F 27/362 333/178
3,142,029 A * 7/1964 Keen, Jr. et al. ..... 336/84 R
(Continued)

FOREIGN PATENT DOCUMENTS

EP 0 061 608 A1 10/1982
GB 837805 A 6/1960
(Continued)

OTHER PUBLICATIONS

International Search Report (PCT/ISA/210) issued on Mar. 27, 2012, by the European Patent Office as the International Searching Authority for International Application No. PCT/EP2012/051417.
(Continued)

*Primary Examiner* — Tsz Chan
(74) *Attorney, Agent, or Firm* — Taft Stettinius & Hollister LLP

(57) ABSTRACT

A dry-type electrical transformer includes a coil assembly having at least one winding wound into a plurality of concentric turns, at least one cooling sector defined between adjacent concentric turns, spacers positioned inside the cooling sector and spaced from each other to allow a plurality of air ducts each defined between two adjacent spacers, and at least one electrical shield positioned in the cooling sector and arranged to electrically shield the air ducts. At least one electrical shield is positioned in the cooling sector and arranged to electrically shield the air ducts. The electrical shield include a first end edge connected to the turn at the inner side of the cooling sector, a second end edge which is free and electrically insulated from the surrounding parts, and a central portion extending between the first and second end edges and is positioned at the outer side of the spacers.

8 Claims, 5 Drawing Sheets

(51) Int. Cl.

| | |
|---|---|
| ***H01F 27/36*** | (2006.01) |
| ***H01F 27/00*** | (2006.01) |
| ***H01F 27/28*** | (2006.01) |
| ***H01F 41/06*** | (2016.01) |

(56) References Cited

U.S. PATENT DOCUMENTS

| | | | | |
|---|---|---|---|---|
| 3,678,428 | A | 7/1972 | Morris et al. | |
| 4,173,747 | A * | 11/1979 | Grimes et al. | 336/60 |
| 4,663,603 | A * | 5/1987 | van Riemsdijk et al. | H01F 27/324 174/DIG. 25 |
| 5,588,201 | A | 12/1996 | Alber et al. | |
| 2008/0024256 | A1 | 1/2008 | Pauley et al. | |
| 2008/0211611 | A1 | 9/2008 | Hanov | |
| 2010/0162557 | A1 | 7/2010 | Pauley, Jr. et al. | |

FOREIGN PATENT DOCUMENTS

| | | | |
|---|---|---|---|
| JP | 58-054615 | A | 3/1983 |
| WO | WO 2008/013600 | A2 | 1/2008 |

OTHER PUBLICATIONS

Written Opinion (PCT/ISA/237) issued on Mar. 27, 2012, by the European Patent Office as the International Searching Authority for International Application No. PCT/EP2012/051417.

* cited by examiner

DRY-TYPE TRANSFORMER AND METHOD OF MANUFACTURING A DRY-TYPE TRANSFORMER

RELATED APPLICATIONS

This application claims priority as a continuation application under 35 U.S.C. §120 to PCT/EP2012/051417, which was filed as an International Application on Jan. 30, 2012 designating the U.S., and which claims priority to European Application 11153738.7 filed in Europe on Feb. 8, 2011. The entire contents of these applications are hereby incorporated by reference in their entireties.

FIELD

The present disclosure relates to an electrical transformer. More particularly, the present disclosure relates to a dry-type electrical transformer having an improved coil assembly, and to a method of manufacturing a dry-type electrical transformer.

BACKGROUND INFORMATION

The basic task of electrical transformers is to allow for the exchange of electric energy between two or more electrical systems of usually different voltages. In practice, a transformer converts electricity at one voltage to electricity at another voltage, either of higher or lower value.

Most common electrical transformers generally include a magnetic core composed by one or more legs or limbs connected by yokes which together form one or more core windows. Around the legs there are arranged corresponding primary and secondary coil assemblies, wherein each coil assembly is composed by one or more phase windings, for example, low-voltage windings, and/or high-voltage windings. The phase windings are usually realized by winding around a mandrel suitable conductors, for example foils, wires, or cables, or strips, so as to achieve the desired number of turns.

Some known winding techniques used to form coils are the so-called foil winding and disc or foil-disc winding techniques. In practice, in the foil winding technique, a full-width foil of electrical conductor is used, while in the disc or foil-disc winding technique, a portion of the foil is used, namely having a width corresponding to that of the disc to be wound.

The type of winding technique that is utilized to form a coil is primarily determined by the number of turns in the coil and the current in the coil.

For high voltage windings with a large number of required turns, the disc or foil-disc winding technique is generally used, whereas for low voltage windings with a smaller number of required turns, the foil winding technique is generally used.

One important aspect in manufacturing electrical transformers resides in its capability to be cooled. During operation, electrical transformers generate a substantial amount of heat which should be dissipated as much as possible in order to avoid overheating that would negatively affect the electrical performances of the transformers.

In order to achieve the needed cooling, a known solution consists in including into the windings one or more cooling sectors or ducts defined between adjacent turns. A cooling fluid, such as air in the case of dry-type transformers, circulates inside these cooling sectors or ducts.

The embodiment of cooling sectors or air ducts into the windings is to some extent rather difficult and cumbersome, especially when turns are wound in a disc-type configuration.

Further, the inclusion of air ducts in a winding of a dry-type transformer can result in a difference in electrical capacitance between the two adjacent turns delimiting the cooling sector or air ducts and the rest of the turns themselves. This results in an uneven voltage distribution over the turns during high frequency voltage surges, for example, lightning impulses, and can lead to breaks of the insulating material in the cooling sector of air ducts.

SUMMARY

A dry-type electrical transformer includes a coil assembly having at least one winding, which includes an electrical conductor wound around a longitudinal axis into a plurality of concentric turns. The exemplary transformer also includes at least one cooling sector defined between adjacent turns of the plurality of concentric turns, and a plurality of spacers which are positioned inside the at least one cooling sector and are spaced from each other so as to allow having a plurality of air ducts each defined between two adjacent spacers of the plurality of spacers. In addition, the exemplary transformer includes at least one electrical shield which is positioned in the at least one cooling sector and is arranged so as to electrically shield the plurality of air ducts. The at least one electrical shield includes a first end edge which is connected to the turn at the inner side of the cooling sector, a second end edge which is free and electrically insulated from the surrounding parts, and a central portion which extends between the first and second end edges and is positioned at the outer side of the plurality of spacers.

An exemplary embodiment of the present disclosure provides a method of manufacturing a dry-type transformer. The exemplary method includes a) winding an electrical conductor around a longitudinal axis into a first plurality of concentric turns so as to form a first portion of a winding of a coil assembly. The exemplary method also includes b) forming at least one cooling sector by positioning around the last turn wound of the first plurality of concentric turns a plurality of spacers which are spaced from each other so as to form a plurality of air ducts each defined between two adjacent spacers of the plurality of spacers, and thereafter continuing winding the electrical conductor around the longitudinal axis into a second plurality of concentric turns so as to form a second portion of the winding of a coil assembly. The first turn of the second plurality of concentric turns is positioned at the outer side of the plurality of spacers. Step b) includes providing an electrical shield at the at least one cooling sector, where the electrical shield is arranged so as to electrically shield the plurality of air ducts. The providing an electrical shield at the at least one cooling sector includes connecting one end edge of the at least one electrical shield to the last turn wound of the first plurality of concentric turns and positioning a central portion of the at least one electrical shield on the outer side of the at least one cooling sector between the outer side of the plurality of spacers and the first turn wound of the second plurality of concentric turns and leaving a second end edge of the electrical shield free and electrically insulated from the surrounding parts.

BRIEF DESCRIPTION OF THE DRAWINGS

Additional refinements, advantages and features of the present disclosure are described in more detail below with reference to exemplary embodiments illustrated in the drawings, in which.

Figure 1:
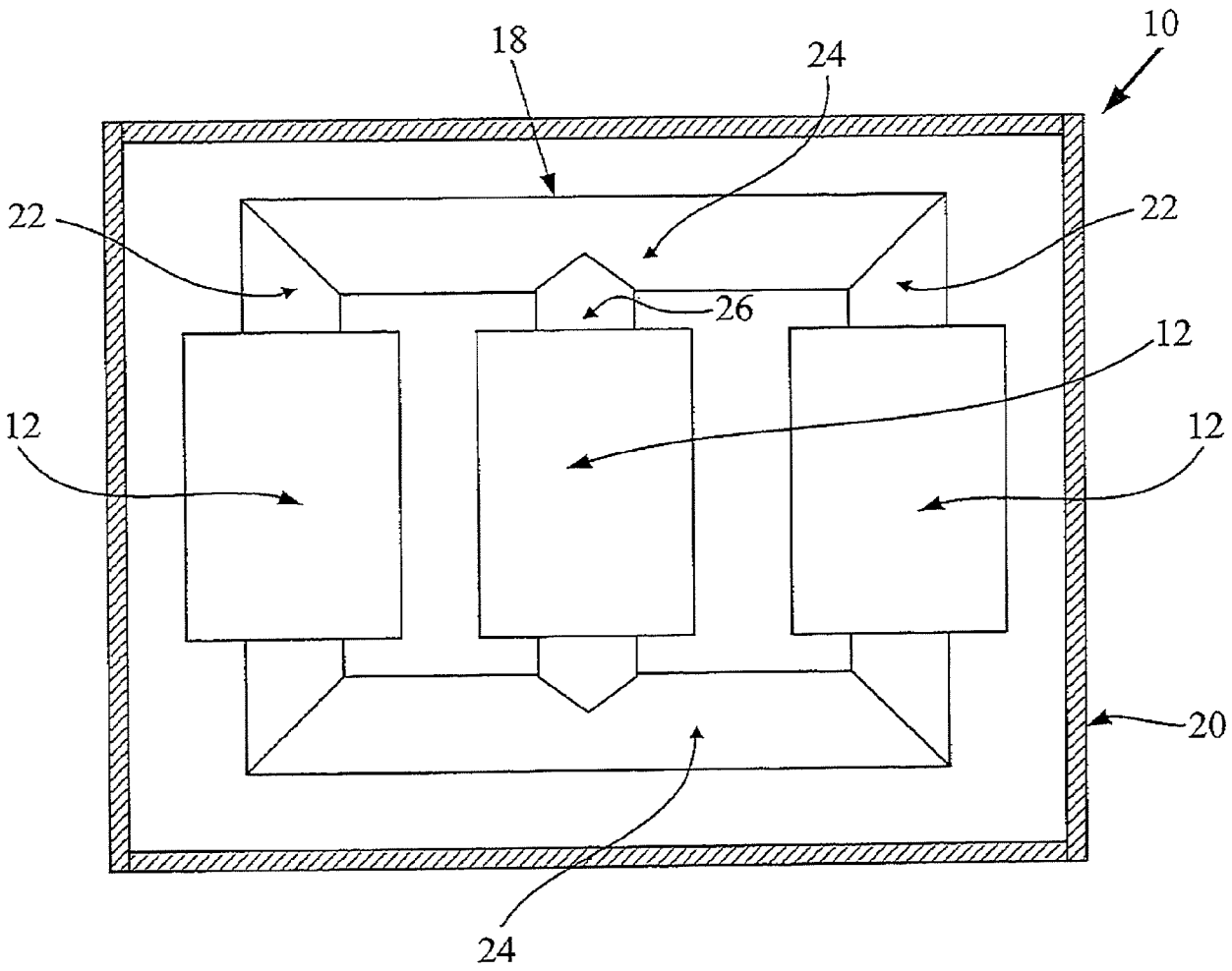
FIG. 1 is a schematic sectional view of a transformer in accordance with an exemplary embodiment of the present disclosure.

It should be noted that in the detailed description that follows, identical or similarly functioning components have the same reference numerals, regardless of whether they are shown in different exemplary embodiments of the present disclosure. It should also be noted that in order to clearly and concisely disclose the present disclosure, the drawings can not necessarily be to scale and certain features of the present disclosure can be shown in somewhat schematic form.

DETAILED DESCRIPTION

Exemplary embodiments of the present disclosure provide a dry-type electrical transformer and a method of manufacturing a dry-type electrical transformer having improvements over known techniques.

Accordingly, an exemplary embodiment of the present disclosure provides a dry-type electrical transformer including a coil assembly having at least one winding, where the at least one winding includes an electrical conductor wound around a longitudinal axis into a plurality of concentric turns. The transformer also includes at least one cooling sector defined between adjacent turns of the plurality of concentric turns, and a plurality of spacers which are positioned inside the at least one cooling sector and are spaced from each other so as to allow having a plurality of air ducts each defined between two adjacent spacers of the plurality of spacers. At least one electrical shield is positioned in the at least one cooling sector and is arranged so as to electrically shield the plurality of air ducts. The at least one shield includes a first end edge which is connected to the turn at the inner side of the cooling sector, a second end edge which is free and electrically insulated from the surrounding parts, and a central portion which extends between the first and second end edges and is positioned at the outer side of the plurality of spacers.

Also provided in accordance with an exemplary embodiment of the present disclosure is a method of manufacturing a dry-type transformer. The exemplary method includes the following steps:

a) winding an electrical conductor around a longitudinal axis into a first plurality of concentric turns so as to form a first portion of a winding of a coil assembly; and b) forming at least one cooling sector by positioning around the last turn wound of the first plurality of concentric turns a plurality of spacers which are spaced from each other so as to form a plurality of air ducts each defined between two adjacent spacers of the plurality of spacers, and thereafter continuing winding the electrical conductor around the longitudinal axis into a second plurality of concentric turns so as to form a second portion of the winding of a coil assembly, wherein the first turn of the second plurality of concentric turns is positioned at the outer side of the plurality of spacers.

Step b) includes providing an electrical shield at the at least one cooling sector, where the electrical shield is arranged so as to electrically shield the plurality of air ducts. The providing an electrical shield at the at least one cooling sector includes connecting one end edge of the at least one electrical shield to the last turn wound of the first plurality of concentric turns and positioning a central portion of the at least one electrical shield on the outer side of the at least one cooling sector between the outer side of the plurality of spacers and the first turn wound of the second plurality of concentric turns and leaving a second end edge of the electrical shield free and electrically insulated from the surrounding parts.

Further, the method of manufacturing and dry-type transformer according to the present disclosure will be described by predominantly making reference to a three-phase foil-disc dry-type transformer without intending in any way to limit their possible field and scope of application.

FIG. 1 schematically shows an interior view of a three-phase transformer 10 containing a coil embodied in accordance with the present disclosure. The transformer 10 includes three coil assemblies 12 (one for each phase) mounted to a core 18; these elements can be enclosed within a ventilated outer housing 20. The core 18 includes a pair of outer legs 22 extending between a pair of yokes 24. A central leg 26 also extends between the yokes 24 and is disposed between and is substantially evenly spaced from the outer legs 22. The coil assemblies 12 are mounted to and disposed around the outer legs 22 and the inner leg 26, respectively. Each coil assembly 12 includes a high voltage winding (which can be indicated also as high voltage coil) 30 and a low voltage winding (which can be indicated also as low voltage coil), each of which is cylindrical in shape. If the transformer 10 is a step-down transformer, the high voltage winding or coil 30 is the primary coil and the low voltage winding or coil is the secondary coil. Alternately, if the transformer 10 is a step-up transformer, the high voltage coil 30 is the secondary coil and the low voltage coil is the primary coil. In each coil assembly 12, the high voltage coil 30 and the low voltage coil can be mounted concentrically, with the low voltage coil being disposed within and radially inward from the high voltage coil 30. Alternately, the high voltage coil 30 and the low voltage coil can be mounted so as to be axially separated, i.e. stacked with the low voltage coil being mounted above or below the high voltage coil 30.

Although the transformer 10 is shown and described as being a three phase distribution transformer, it should be appreciated that the present disclosure is not limited to three phase transformers or distribution transformers. The present disclosure can be utilized in single phase transformers and transformers other than distribution transformers.

Figure 2:
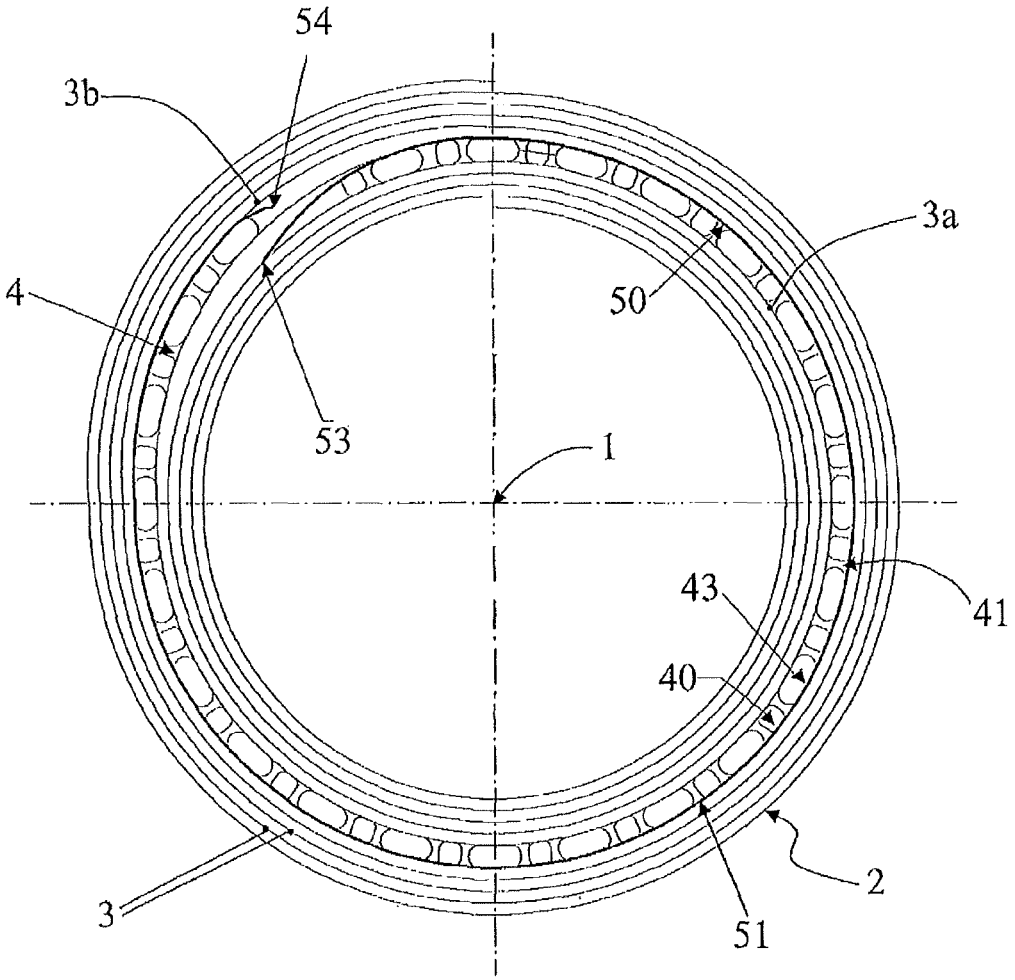
FIG. 2 schematically shows a cross-section of a winding according to an exemplary embodiment of the present disclosure.

As illustrated in FIG. 2, a coil assembly 12 includes at least one winding which includes an electrical conductor 2 wound into a plurality of concentric turns 3, around a longitudinal axis 1, namely an axis extending along the corresponding leg 22, or 26.

The conductor 2 may be composed, for example, of a metal such as copper or aluminum and can be in any suitable form such as a wire, cable, etc. In accordance with an exemplary embodiment, in the transformer and method according to the present disclosure, the conductor 2 is composed of a metal such as copper or aluminum in the form of a foil.

For example, a low voltage winding is obtained by winding, for example a full width foil conductor 2 in a foil configuration until the desired number of turns is achieved; hence, in this case the foil conductor 2 is thin and rectangular, with a width as wide as the entire height (measured parallel to the reference axis 1) of the winding 30.

Figure 3:
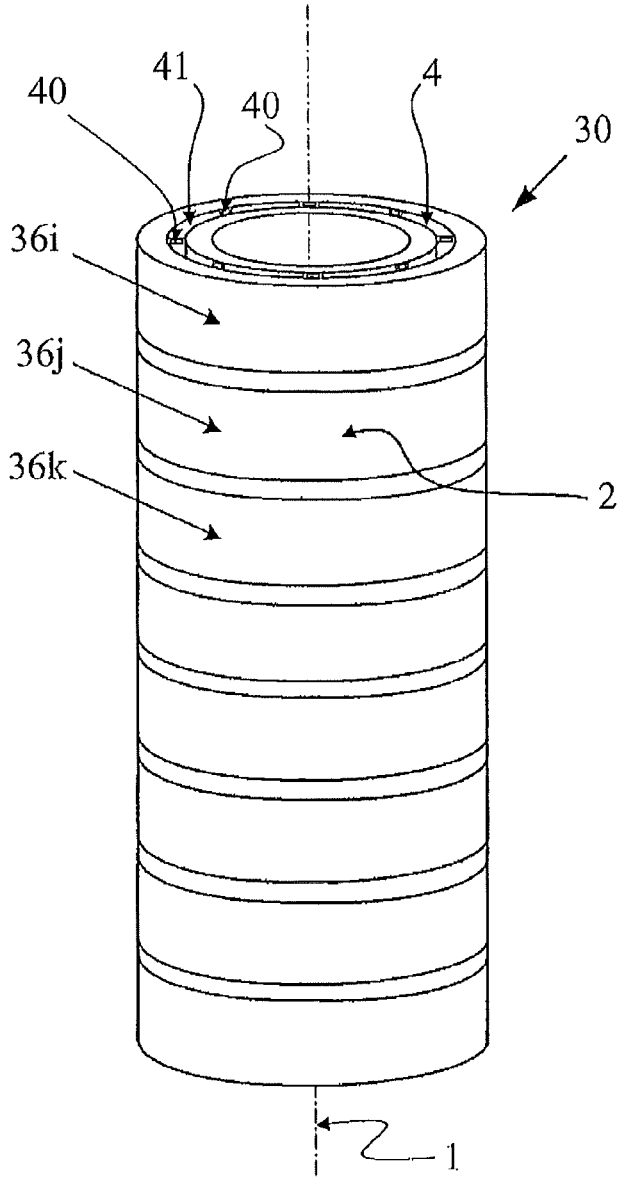
FIG. 3 is a perspective view illustrating a high voltage winding realized according to an exemplary embodiment of the present disclosure in a disc-like configuration.

FIG. 3 shows one of the high voltage coils or windings 30, which is constructed in accordance with the present disclosure, for example, in a disc-like configuration, with a plurality of discs 36. In this case, the conductor 2 is composed of a metal such as copper or aluminum and is in the form of a portion of a foil, i.e. the conductor 2 is thin and rectangular, with a width as wide as the single disc winding 36 it forms.

In each configuration, the turns of the conductor 2 are wound in a radial direction, one on top of the other, i.e., one turn per layer. A layer of insulating material 2*a* (see FIG. 5 for example) is disposed between each layer or turn of the conductor 2. In this manner, there are alternating layers of the conductor 2 and the insulating material 2*a*. The insulating material can be composed of a polyamide film, such as that sold under the trademark Nomex®; a polyamide film, such as that sold under the trademark Kapton®, or a polyester film, such as that sold under the trademark Mylar®, or any other suitable material.

At least one cooling sector 4, i.e. a space for favoring cooling, is defined between adjacent turns 3*a*, 3*b* of the plurality of concentric turns 3.

A plurality of spacers 40 are positioned, for example, in a non-removable way, inside the at least one cooling sector 4 and are spaced from each other so as to allow forming a plurality of air ducts 41. In practice, the spacers 40 are placed along the circular sector defined between the inner turn 3*a* and the outer turn 3*b* delimiting the cooling sector 4.

Each air duct 41 is defined between two adjacent spacers 40 inside this circular sector 4.

The number of spacers 40 and air ducts 41 shown in the figures should not be construed as limiting the scope of the present disclosure; a greater or lesser number of spacers 40 and/or ducts 41 can be utilized.

Likewise, for the sake of simplicity, the present disclosure will be described by making reference to the presence of only one cooling sector 4; it is clear that each winding of a coil assembly 12 can include more cooling sectors 4, each defined between two corresponding adjacent turns 3.

For example, in case of disc windings, the spacers 40 can be formed by small blocks of insulating material, in whichever shape suitable for the application, or in case of full width foil configuration, by longer sticks or bars.

Figure 4:
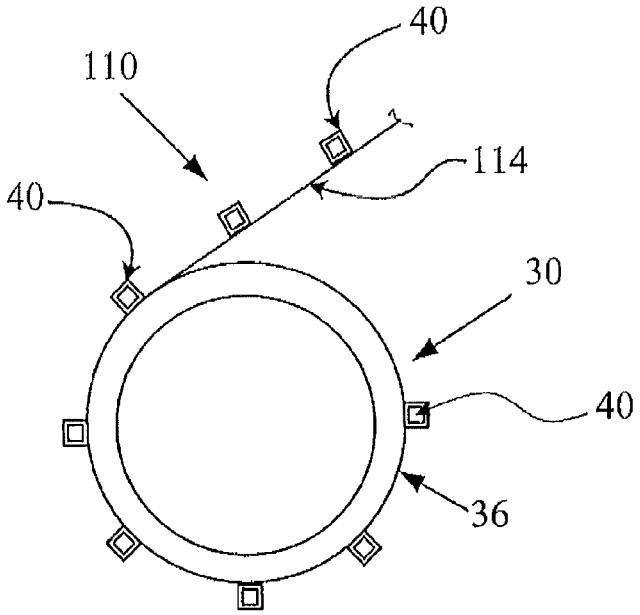
FIGS. 4-6 schematically show a coil winding being formed with a manufacturing method according to an exemplary embodiment of the present disclosure.
Figure 5:
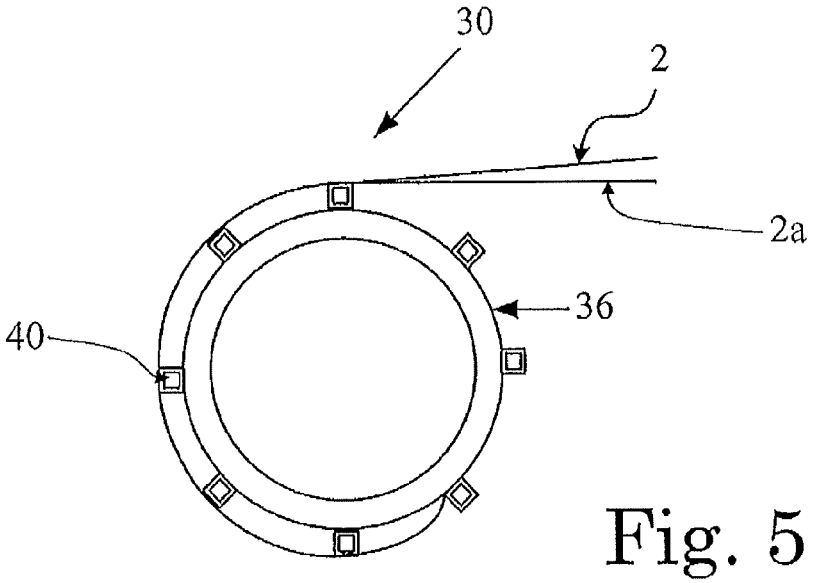
Figure 6:
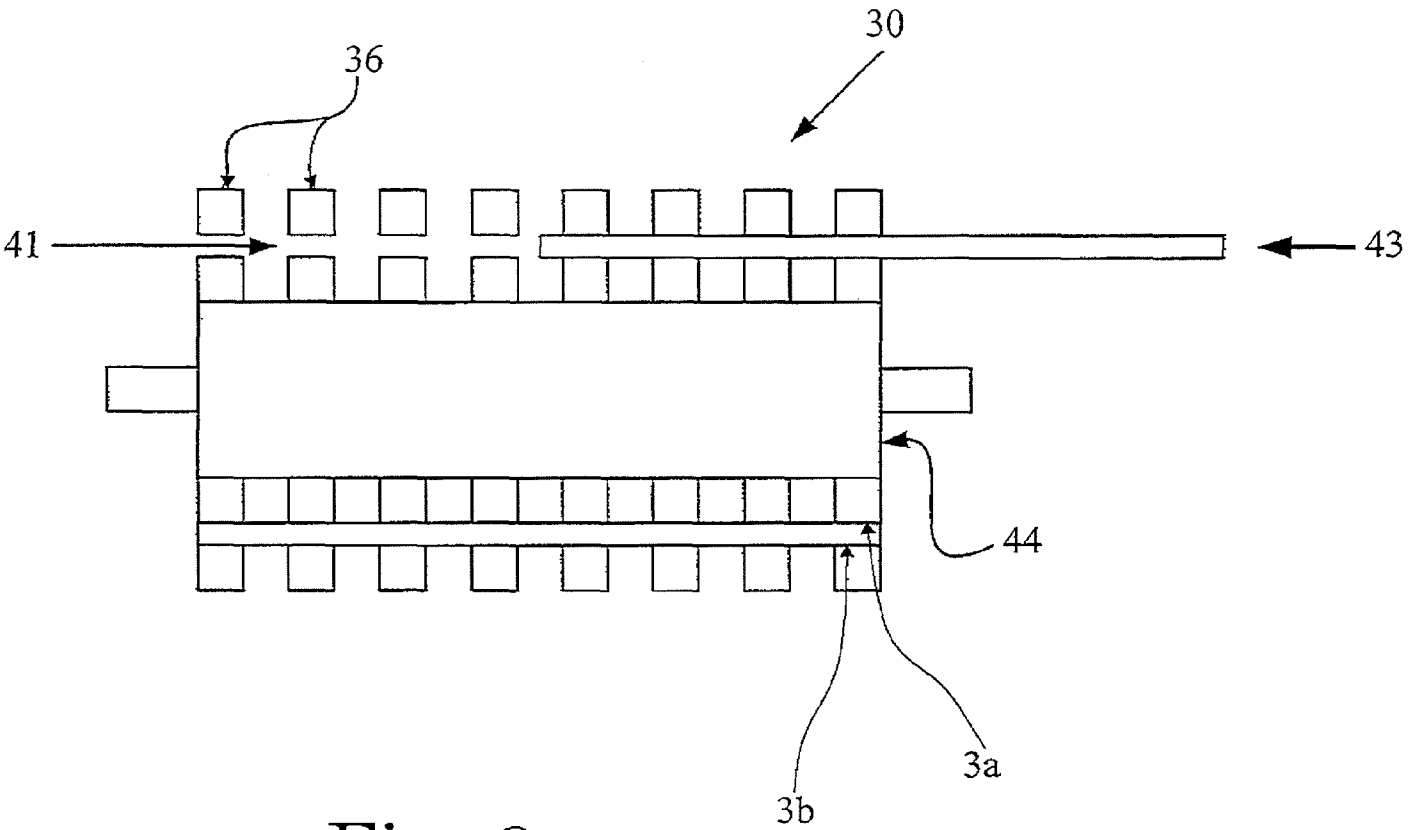

In accordance with an exemplary embodiment, the spacers 40 are secured in a spaced-apart manner to a piece of tape indicated only in FIGS. 4, 5 by the reference number 110; the piece of tape 110 is wound around at least a portion of an associated turn 3.

In accordance with an exemplary embodiment, in the transformer 10 according to the present disclosure, at least one electrical shield 50 is positioned in the cooling sector 4 and is arranged so as to electrically shield the plurality of air ducts 41.

In accordance with an exemplary embodiment, the at least one electrical shield 50 includes a piece of electrical conductor. According to an exemplary embodiment, the electrical shield 50 includes an additional pre-cut piece 50 of the same electrical conductor 2 which is used to form the plurality of concentric turns 3.

According to an exemplary embodiment as shown in FIG. 2, the electrical shield 50 includes: a first end edge 53 which is electrically connected to the turn 3 at the inner side of the cooling sector 4; a second end edge 54 which is left open, i.e. free from any connection, and is electrically insulated from the surrounding area, and for example, from the adjacent turns. In practice this second edge 54 can be electrically insulated by folding around it a part of an associated insulating layer and lies free, close to—and after—the last spacer 40. A central and largely predominant portion of the shield 50 extends almost circumferentially between the two end edges 53 and 54 and is positioned on the outer side of the cooling sector 4 between the outer side of the plurality of spacers 40 and the outer turn immediately adjacent to the spacers themselves.

Referring now to FIGS. 2, 4-6 the manufacturing method of one of the high voltage windings 30 will be described in its essential steps.

First, a disk-foil conductor 2 together with its associated layer of insulating material 2*a* is wound, for example around a mandrel 44, until a desired number of turns of a disc winding 36 is obtained. For example, a half-disc 36 can be initially wound.

Then, a cooling sector 4 is formed. For example, a pre-prepared electrical shield 50 of the type previously described is provided and is connected at its one end edge 53 to the outer side of the last turn wound. This operation can be executed manually, in an automatic way or both.

Then, the portion of disc winding 36 already wound is wrapped on the outer side with one turn of a spacer tape 110 that includes a plurality of spaced-apart spacers 40 secured to a piece of insulating tape 114 composed of an insulating material, such as polyimide, polyamide, or polyester. In the example illustrated in FIGS. 4-5 the spacers 40 have a rectangular cross-section, while in the example of FIG. 2 they have a rounded profile.

The spacers 40 are for example secured to the tape 114 by an adhesive and extend longitudinally along the width of the tape 114. The spacer tape 110 is wrapped onto the half-disc winding 36 to form a single turn such that the tape 114 adjoins the wound half-disc winding 36 and the spacers 40 extend radially outward like spokes. Ends of each piece of spacer tape 110 can be fastened together (such as by adhesive tape) to form a loop that is disposed radially outward from the half-disc winding 36. The loop can be secured to the radially inward disc winding 36. In lieu of a separate piece of the spacer tape 110 being used to form the single turn, the spacer tape 110 can be part of a long length of the insulating tape 114 that is used to form an outer disc winding 36 over the spacers 40.

After the inner half-disc winding 36 has been wrapped with a piece of spacer tape 110, the outer second-half disc winding 36 is formed over the loop of the spacer tape 110 so as to be supported on the spacers 40 and spaced from the inner half-disc winding 36. For example, before continuing to wind the conductor 2 and forming the second half-disc 36, the electrical shield 50 is positioned so as to be wound substantially together with the first turn of the second half-disc 36.

More in details, the shield 50 is wound together with the conductor 2; for example, the piece of conductor 51 is wrapped over the outer side of the spacer 40, then there is a layer of the insulating material 2*a* and associated portion of the conductor 2. After the shield 50 is wound, the second edge 54 remains free and electrically insulated from the surrounding parts. Thereafter, alternating layers of the insulating material 2*a* and of the conductor 2 are continued to be wound until the outer half-disc winding 36 is formed by a desired number concentric turns 3; in this way, when the outer disc winding 36 is completed, the inner and outer half-discs 36 are separated by a series of circumferentially arranged spaces separated by the spacers 40 as shown for example in FIG. 3.

These operations are repeated for each disc 36 until the desired number of discs 36 forming the winding 30 is achieved with the spacers 40 and air ducts 41 of the various discs 36 which are aligned along the axial length of the high voltage coil 30. In this manner, when the formation of the disc winding is completed, the aligned spacers 40 form a series of passages (shown in FIGS. 3 and 6) extending axially through the partially formed high voltage coil 30 and forming air ducts 41.

If the winding 30 has to be cast, for example with resin, some removable plastic bars or spacers 43 (illustrated in FIGS. 2 and 6) are inserted into the spaces between the spacers 40 after winding is completed. Once the winding 30 is cast, then the bars 43 are removed. The bars 43 are useful for giving a defined final shape to the air ducts 41 and may, for example, have a conical shape in order to ease their extraction. In addition, pieces of flexible material can be located at the end of the bars 43 in order to provide a good fitting into the casting mold.

The removable bars 43 are not needed if the winding is not cast, in which case the air ducts 41 are formed substantially by the spaces defined between adjacent spacers 40.

The above steps are about the same in case a full width foil conductor 2 is wound; in this case the spacers 40 can be in the form or stick or bars having a length (measured in a direction parallel to the longitudinal axis 1) close to the width of the foil conductor 2.

The presence of air ducts 41 in the windings increases the cooling surface of the transformer and therefore its capability to release heat into the ambient; further, the electrical shield 50, which in practice constitutes a kind of additional turn, allows to substantially reduce a voltage drop which can occur in both sides of the air ducts.

It is to be understood that the description of the foregoing exemplary embodiment(s) is/are intended to be only illustrative, rather than exhaustive, of the present disclosure. Those of ordinary skill will be able to make certain additions, deletions, and/or modifications to the embodiment(s) of the disclosed subject matter without departing from the spirit of the present disclosure or its scope, as defined by the appended claims.

For example, in the above description for the sake of simplicity, the presence of only one cooling sector 40 and related air ducts 41 was described. Clearly, when winding, a desired number of cooling sectors (with corresponding spacers and air ducts) can be realized, with each cooling sector being defined at a desired radial location between successive turns. The number, type, shape and size of the spacers can be any depending on the specific application provided they are compatible with the purpose of the present disclosure, etc. The electrical shield 50 can be made of or include a piece of different conductor, or even be associated to an additional layer of electrically insulating material which is operatively associated to the pre-cut piece of electrical conductor.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A dry-type electrical transformer comprising:

a coil assembly including at least one winding, the at least one winding comprising an electrical conductor wound around a longitudinal axis into a plurality of concentric turns;

at least one cooling sector defined between adjacent turns of the plurality of concentric turns, the at least one cooling sector being defined between an inner turn and an outer turn among the plurality of turns, the inner turn being arranged at an inner side of the cooling sector closer to the longitudinal axis than the outer turn arranged at an outer side of the cooling sector;

a plurality of spacers which are positioned inside the at least one cooling sector and are spaced from each other so as to allow having a plurality of air ducts each defined between two adjacent spacers of the plurality of spacers;

at least one electrical shield which is positioned between the inner and outer turns and arranged in the at least one cooling sector so as to electrically shield the plurality of air ducts, wherein the at least one electrical shield comprises a first end edge which is connected to the inner turn at the inner side of the cooling sector, a second end edge which is free of electrical connection to the inner and outer turns and electrically insulated from the inner and outer turns, and a central portion which extends between the first and second end edges and is positioned at the outer side of the plurality of spacers.

2. The dry-type electrical transformer according to claim 1, wherein the at least one electrical shield comprises a piece of electrical conductor.

3. The dry-type electrical transformer according to claim 2, wherein the at least one electrical shield comprises an additional pre-cut piece of the electrical conductor forming the plurality of concentric turns.

4. The dry-type electrical transformer according to claim 1, comprising:

a piece of tape having the spacers secured thereto in a spaced-apart manner.

5. The dry-type electrical transformer according to claim 2, wherein the electrical conductor is wound in a foil-type or disc-type configuration around the longitudinal axis.

6. The dry-type electrical transformer according to claim 3, wherein the electrical conductor is wound in a foil-type or disc-type configuration around the longitudinal axis.

7. The dry-type electrical transformer according to claim 6, comprising:

a piece of tape having the spacers secured thereto in a spaced-apart manner.

8. The dry-type electrical transformer according to claim 1, wherein the second end edge of the at least one electrical shield is unconnected to the surrounding parts.

* * * * *